United States Patent [19]

Cox

[11] Patent Number: 4,904,219

[45] Date of Patent: Feb. 27, 1990

[54] HAND FLYER

[76] Inventor: Glenn M. Cox, P.O. Box 450, Glide, Oreg. 97443

[21] Appl. No.: 237,278

[22] Filed: Aug. 26, 1988

[51] Int. Cl.[4] ..... A63H 27/12; A63B 65/00

[52] U.S. Cl. ..... 446/36; 446/44; 273/428

[58] Field of Search ..... 446/34, 36, 37, 38, 446/39, 44, 45; 273/424, 425, 426, 427, 428

[56] References Cited

U.S. PATENT DOCUMENTS

| | | | |
|---|---|---|---|
| 913,381 | 2/1909 | Hay | 446/34 |
| 1,413,316 | 4/1922 | Bradley | 273/428 X |
| 1,651,273 | 11/1927 | Heller | 446/34 |
| 2,899,773 | 8/1959 | Lockwood | 446/34 |
| 2,921,404 | 1/1960 | Lescher | 446/34 |
| 3,353,295 | 11/1967 | Downey | 446/45 |
| 3,665,641 | 5/1972 | Henderson | 446/45 |
| 3,691,674 | 9/1972 | Thompson | 446/34 |
| 3,947,993 | 4/1976 | Hoppe | 446/45 |

FOREIGN PATENT DOCUMENTS

| | | | |
|---|---|---|---|
| 1501685 | 2/1978 | United Kingdom | 446/34 |
| 1572692 | 7/1980 | United Kingdom | 273/428 |
| 2093710 | 9/1982 | United Kingdom | 446/34 |

*Primary Examiner*—Mickey Yu
*Assistant Examiner*—D. Neal Muir
*Attorney, Agent, or Firm*—Richard L. Miller

[57] ABSTRACT

This hand flyer is so designed as to be of a specific one piece construction that includes certain aerodynamic characteristics that enable it to be thrown upward vertical, whereupon its descent will perform a spiral motion. Primarily, it consists of a body having a tapered wing portion and a forward head portion projects outward from the body.

2 Claims, 1 Drawing Sheet

HAND FLYER

BACKGROUND OF THE INVENTION

The instant invention relates generally to missile toys, and more particularly, to a hand flyer.

Numerous missile toys have been provided in the prior art that are adapted to have aero-dynamic flight characteristics. For example, U.S. patents numbered 3,119,196 of Alberico et al, 1,651,273 of Heller, and 1,413,316 of Bradley, all are illustrative of such prior art. While these units may be suitable for the particular purpose to which they address, they would not be as suitable for the purpose of the present invention as hereafter described.

SUMMARY OF THE INVENTION

A primary object of the present invention is to provide a hand flyer that will overcome the shortcomings of the prior art devices.

Another object is to provide a hand flyer that will be of such design, as to have the characteristics of an aerodynamic wing for its flight.

An additional object is to provide a hand flyer that will be of light weight plastic having a tapered wing for giving it rigid form to be thrown upward.

A further object is to provide a hand flyer that is simple and easy to use.

A still further object is to provide a hand flyer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
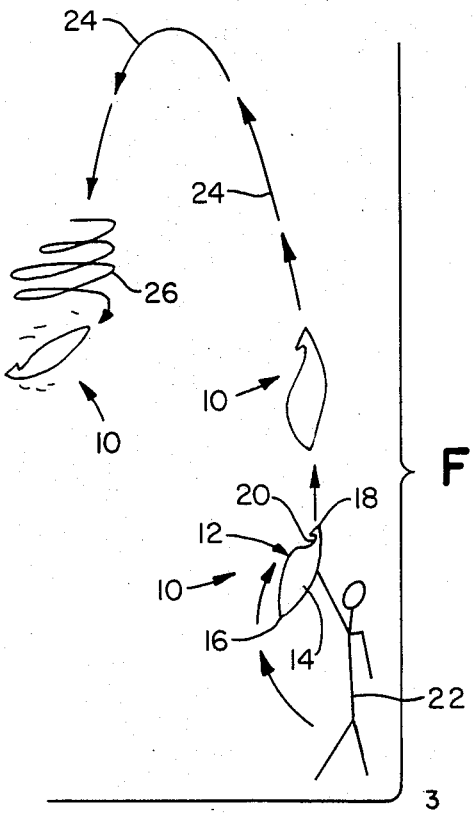
FIG. 1 is diagrammatic view showing the employment of the instant invention.
Figure 4:
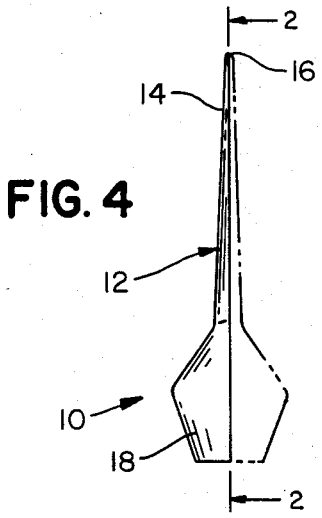
FIG. 4 is a partial frontal elevational view thereof, taken on line 4—4 of FIG. 2.
Figure 2:
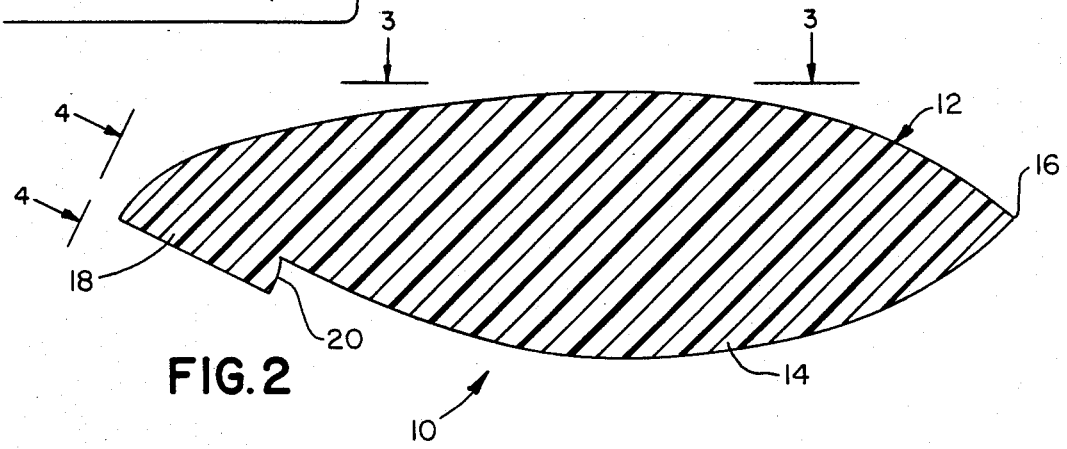
FIG. 2 is a cross sectional view taken on either line 2—2 of FIG. 3 or line 2—2 of FIG. 4.
Figure 3:
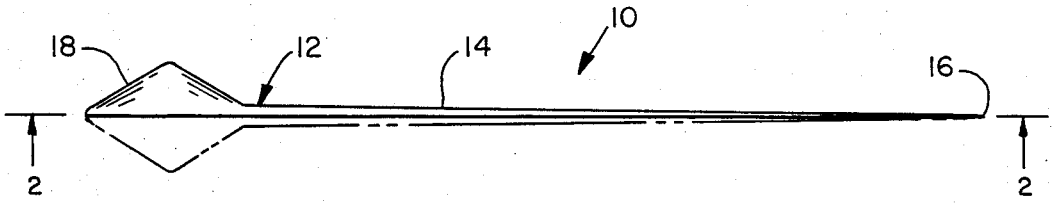
FIG. 3 is a partial top elevational view thereof taken on line 3—3 of FIG. 2.

Turning now descriptively to the drawings, in which like reference characters denote like elements throughout the several views. A hand flyer 10 is shown to include a body 12 fabricated preferably of plastic, having a wing portion 14 integrally attached that is curved on side edges and tapers to a pointed end 16. A head portion 18 integrally attached to the forward end of the body 12, extends outward on both sides, and an arcuate cut-out 20 is provided under the head portion 18, and it is to be noted that there are no moving elements in the structure.

In use, hand flyer 10 is launched by being hand thrown by the user 22 as illustrated in FIG. 1, the body 12 being held behind the head portion 18 and launched upward vertically to approximately sixty or more feet as indicated by the arrows 24. At the top of the launch, the areodynamic shape of flyer 10 causes a spiral downward motion indicated by the numerical character 26.

It is also to be noted that the instant invention may be alternatively launched with a rubber band sling shot type device as are well known in the art (but not shown) if a flight from a higher distanced. In this case the rubber band is hooked in arcuate cut-out 20.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A plastic aerial flyer toy adapted to be launched in a straight path in a substantially vertical direction, and upon reaching its maximum altitude to descend in a spiral path comprising:

(a) a head having a substantially pointed front end, the top of said head diverging in a gradual manner rearwardly from said front end and the bottom of said head diverging in a straight line rearwardly, the sides of said head diverging outwardly from said front end to a point substantially midway along said head and then converging inwardly toward a junction where the head is joined to the body of said toy to form a mound like projection extending symmetrically from both sides of said head; and, (b) a body substantially longer than said head integrally connected to said head at said junction, said body terminating at a point at its rearmost end, said body further having flat sidewalls which extend linearly from said junction and converge at said rearmost point, the top of said body portion diverging slightly from said junction and then converging rapidly to said point, and the bottom of said body portion diverging smoothly from said junction and then converging smoothly to said point whereby both the top and bottom of said body portion form substantially convex arcuated aerodynamic shapes.

2. A plastic aerial flyer toy as in claim 1 which includes an arcuate notch extending inwardly a short distance at the junction at the bottom of said toy, said notch being adapted to fit against the rubber band portion of a conventional sling shot for launching said toy in a vertical direction.

* * * * *